US009370285B2

(12) United States Patent
Visel et al.

(10) Patent No.: US 9,370,285 B2
(45) Date of Patent: Jun. 21, 2016

(54) BATTERY-POWERED HANDHELD VACUUM DEVICE

(71) Applicants: Benjamin Visel, Bad Liebenzell-Moettlingen (DE); Heiko Roehm, Stuttgart (DE); Georgios Margaritis, Schwieberdingen (DE)

(72) Inventors: Benjamin Visel, Bad Liebenzell-Moettlingen (DE); Heiko Roehm, Stuttgart (DE); Georgios Margaritis, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/163,950

(22) Filed: Jan. 24, 2014

(65) Prior Publication Data

US 2014/0208538 A1 Jul. 31, 2014

(30) Foreign Application Priority Data

Jan. 28, 2013 (DE) ..... 10 2013 201 282
Jan. 16, 2014 (DE) ..... 10 2014 200 663

(51) Int. Cl.

| | |
|---|---|
| ***A47L 5/24*** | (2006.01) |
| ***A47L 9/12*** | (2006.01) |
| ***A47L 9/22*** | (2006.01) |
| ***A47L 9/28*** | (2006.01) |

(52) U.S. Cl.

CPC . *A47L 5/24* (2013.01); *A47L 9/122* (2013.01); *A47L 9/22* (2013.01); *A47L 9/2884* (2013.01)

(58) Field of Classification Search

CPC ..... A47L 5/24; A47L 5/28
USPC ..... 15/344, 347, 323
See application file for complete search history.

(56) References Cited

U.S. PATENT DOCUMENTS

| | | | | |
|---|---|---|---|---|
| 4,917,239 | A * | 4/1990 | Smith | 206/349 |
| 4,920,608 | A * | 5/1990 | Hult et al. | 15/339 |
| 4,955,105 | A * | 9/1990 | Sunagawa et al. | 15/323 |
| 4,967,443 | A * | 11/1990 | Krasznai et al. | 15/347 |
| 5,533,843 | A * | 7/1996 | Chung | 408/241 R |
| 6,267,238 | B1 * | 7/2001 | Miller et al. | 206/349 |
| 6,493,903 | B1 * | 12/2002 | Super | 15/324 |
| 6,546,592 | B1 * | 4/2003 | Cockburn et al. | 15/344 |
| 6,883,202 | B2 * | 4/2005 | Steffen et al. | 15/323 |
| 7,845,046 | B2 * | 12/2010 | Milligan et al. | 15/352 |
| 8,661,609 | B2 * | 3/2014 | Knopow | A47L 5/14 15/200 |
| 2004/0216264 | A1 * | 11/2004 | Shaver et al. | 15/344 |

FOREIGN PATENT DOCUMENTS

EP 1 523 916 4/2005

* cited by examiner

*Primary Examiner* — Dung Van Nguyen
(74) *Attorney, Agent, or Firm* — Norton Rose Fulbright US LLP

(57) ABSTRACT

A battery-powered handheld vacuum device for use on building sites includes: a dust collection box; and a motor housing, in which a drive motor provided with a fan impeller and a battery pack for supplying current to the drive motor independently of an electrical network are provided. The dust collection box is fixed in place on the motor housing in releasable manner. A handle, with which the battery pack engages at least sectionally, is formed on the motor housing.

28 Claims, 7 Drawing Sheets

BATTERY-POWERED HANDHELD VACUUM DEVICE

BACKGROUND OF THE INVENTION

1. Field of the Invention

The present invention relates to a battery-powered handheld vacuum for use at building sites, which has a dust collection box and a motor housing; situated inside the motor housing are a drive motor equipped with a fan impeller and a battery pack to supply current to the drive motor independently of an electrical network, the dust collection box being mounted on the motor housing so as to be detachable.

2. Description of Related Art

A battery-powered handheld vacuum device of this type is known from published European patent application document EP 1 523 916 A2; it includes a dust collection box that is mounted on a motor housing in detachable manner; situated inside the motor housing are a drive motor equipped with a fan impeller and a battery pack for supplying current to the drive motor independently of an electrical network. A cup-shaped main filter is disposed inside the dust collection box; it is enclosed by a pre-filter, which is likewise developed in the shape of a cup and situated in the dust collection box coaxially to the main filter. The pre-filter and the main filter share a common axis of rotation, which extends coaxially to an axis of rotation of the fan impeller and the drive motor accommodated in the motor housing, the impeller fan having an outer diameter that is greater than an outer diameter assigned to the main filter, but smaller than an outer diameter assigned to the pre-filter.

The disadvantage of the related art is that the length of this battery-operated handheld vacuum device is relatively long due to the coaxial placement of the cup-shaped filters, fan impeller and drive motor. Moreover, because of the cup-shaped design of the filters and the thereby specified conditions of the outer diameters of the filters in relation to the fan impeller, this battery-operated handheld vacuum device has a relatively large cross-section in the longitudinal direction.

BRIEF SUMMARY OF THE INVENTION

Therefore, it is an object of the present invention to provide a novel battery-powered handheld vacuum device that has reduced dimensions.

This problem is solved by a battery-powered handheld vacuum device for use at building sites, which has a dust collection box and a motor housing, in which a drive motor equipped with a fan impeller and a battery pack for supplying current to the drive motor in a manner that is independent of an electrical network are situated, the dust collection box being mounted on the motor housing in releasable manner. A handle, with which the battery pack engages at least sectionally in releasable manner, is formed on the motor housing.

The present invention makes it possible to reduce the dimensions of the battery-powered handheld vacuum device and to improve its center of gravity for ergonomic handling.

The fan impeller has an outer diameter, and in the region of the fan impeller, the motor housing has at least one outer width that amounts to maximally 125% of the outer diameter.

Therefore, the present invention makes it possible to provide a battery-powered handheld vacuum device of compact shape, whose cross-section in the longitudinal direction is able to be reduced by reducing the outer width in the region of the fan impeller. Moreover, due to its compact design, this handheld vacuum device is relatively robust with respect to blows and drops and, in particular, compatible with conventional tool carrying cases, such as the L-Boxx® produced by Robert Bosch GmbH.

According to one specific embodiment, the fan impeller is developed in the form of a radial fan impeller, and a redirection device is provided, on which at least two redirection sections are formed, which feature at least one air guidance geometry in each case for redirecting a radial air flow, generated by the radial fan impeller, to form an airflow that is at least virtually coaxially disposed relative to the drive motor.

By providing the redirection device, the present invention enables the use of a fan impeller that has a maximized outer diameter with a reduced housing cross-section, so that a corresponding suction power of the handheld vacuum device is able to be improved during its operation, and the drive motor can be cooled by the axially parallel air flow.

Preferably, the at least one air guidance geometry is developed so that the radial air flow generated by the radial fan impeller, prior to its the redirection into the form of the air flow that is at least virtually coaxially disposed, is rerouted around the radial fan impeller in the form of a spiral.

Thus, the radial air flow is able to be redirected in the direction of sections of the air guidance geometry that are provided to redirect the airflow into the form of the coaxial air flow.

The redirection device preferably has a plate-shaped base, on which the at least two redirection regions are developed.

This makes it possible to provide an uncomplicated and cost-effective redirection device.

Preferably, a predefined multiplicity of redirection regions are provided, which are situated at a distance from each other and are formed in the peripheral region of the plate-shaped base.

In this way an efficient and robust redirection device is able to be provided.

According to one specific embodiment, an air opening, on which the dust collection box is mounted in releasable manner, is formed on the motor housing; a visco-elastic seal, especially an annular rubber sleeve, is situated in the region of the air opening between the dust collection box and the motor housing in order to seal the motor housing and the dust collection box. The visco-elastic seal is preferably designed to attach a filter medium and/or a filter holder supporting the filter medium on the motor housing in airtight manner, especially to latch it into place.

As a result, the present invention makes it possible to provide a battery-powered handheld vacuum device, in which, due to the use of the visco-elastic seal, sealing of the motor housing and the dust collection box is made possible in a manner that is unaffected by tolerances and in which the filter is able to be changed without using tools, in particular. Furthermore, the visco-elastic seal compensates for tolerances between the dust collection box and the motor housing, and also between the filter medium or filter holder and the motor housing, in a manner that is secure and reliable.

Preferably, the at least one approximately planar filter holder is situated in the region of the air opening, and the filter medium is fixed in place on the filter holder, the planar filter holder being situated at an angle with respect to the axis of rotation of the fan impeller.

As a result, it is possible to provide improved and uncomplicated air routing inside the battery-powered handheld vacuum device.

Preferably, the filter medium is developed in the form of a flat pleated filter, which has a rectangular filter base and a multitude of filter pleats, the rectangular filter base being attached to the filter holder.

As a result, it is possible to use a conventional and cost-effective filter medium, which is able to be cleaned easily and quickly.

The air opening preferably is situated at an angle with respect to an axis of rotation of the fan impeller.

This makes it possible to provide an oblique placement of the filter medium or the filter holder in relation to the axis of rotation of the fan impeller.

According to one specific embodiment, the dust collection box has an air intake opening, and at least one air discharge opening is provided on and at the motor housing, the motor housing and the dust collection box being developed to route an air flow that was aspirated into the dust collection box through the air intake opening, to the air discharge opening in at least partially approximately Z-shaped form.

Thus, the present invention makes it possible to provide a battery-powered handheld vacuum device, in which a dust-collection space available in the dust collection box is able to be enlarged because of the Z-shaped air routing.

In the transverse direction, the dust collection box preferably has an at least roughly triangular cross-section with three box corners, the first box corner facing the drive motor, the second box corner featuring an air intake opening, and in the region between the second and third box corner, an air guidance element is provided which is designed to route an air flow, aspirated into the dust collection box through the air intake opening, in the direction of the third box corner.

This makes it possible to provide a dust collection box, in which air routing in the form of a Z is able to be realized in a simple manner by using the air guidance element.

A dust collection space delimited by the air guidance element is developed in the region between the first and second box corner.

It is therefore possible to provide a dust collection box, in which the air guidance element safely and reliably prevents trapped dust particles from escaping from the dust collection box, especially when the handheld vacuum device is switched off.

Preferably, at least one air redirection element is provided in the region of the third box corner, which is designed to redirect the aspirated air flow, routed along the air guidance element, in the direction of the first box corner.

This makes it possible to generate an airflow in the dust collection box that is at least approximately aligned in perpendicular manner in relation to the air discharge opening.

The dust collection box has an opening, preferably in the region between the first and third box corner, in which a filter medium is situated.

This makes it possible to place the filter medium on the dust collection box in a reliable and stable manner.

Preferably, the filter medium extends at least approximately perpendicularly to the air guidance element.

In this way, an at least regionally parallel air flow is able to be generated at the filter medium in a simple manner, so that premature clogging of the filter medium by dust particles is able to be prevented securely and reliably.

Preferably, the dust collection box forms a vacuum device housing together with the motor housing, which has an at least roughly triangular cross-section in the transverse direction; the drive motor is situated in the region between the dust collection box and a first corner of the triangular cross-section, an air intake opening of the dust collection box is situated in a second corner of the triangular cross-section, and the battery pack is disposed in the region of a third corner of the triangular cross-section.

This provides a battery-powered handheld vacuum device that has a compact design, in which at least a reduction in its length in the longitudinal direction is possible due to the triangular cross-section in the transverse direction. Moreover, the handheld vacuum device may advantageously be stored in at least three different ways, e.g., by placing it on one of its lateral surfaces or by placing it on its rear side, on which the battery pack is situated.

A handle is preferably embodied between the second and third corner of the triangular cross-section.

This allows the handheld vacuum device to be operated in a comfortable and operationally reliable manner.

Preferably, an operating element for switching the drive motor on and off is situated on a side of the handle that is facing away from the drive motor.

This makes it easy for an operator to use the thumb of the hand to turn the battery-powered vacuum device on and off. Moreover, the present invention relates to a system which includes a tool carrying case and a battery-powered handheld vacuum device, and the battery-powered handheld vacuum device is designed to be transported in a receiving space of the tool carrying case. A "tool carrying case" in particular refers to a carrying case provided to accommodate at least one handheld machine tool and/or a battery pack. The tool carrying case preferably has at least one base element and a case cover. A "receiving space" in particular denotes a space inside the tool carrying case that encloses the tool carrying case when the case cover is closed. Because of the design of the system according to the present invention, the battery-powered handheld vacuum device and a handheld machine tool are advantageously able to be protected and transported in the same tool carrying case.

In a first development of the present invention, the battery-powered handheld vacuum device takes up less than two thirds of the receiving space of the tool carrying case. This advantageously leaves ample room in the receiving space for at least one handheld machine tool. In this context, "taking up less than two thirds of the receiving space" means that the handheld vacuum device fills less than 66% of a volume of the receiving space. The handheld vacuum device preferably takes up less than one half of the receiving space.

Preferably, the battery-powered handheld vacuum device has at least one outer extension parallel to a main extension plane of the handheld vacuum device, of less than 250 mm, advantageously less than 220 mm, especially advantageously, less than 200 mm. This advantageously leaves ample room in the receiving space of the tool carrying case for at least one handheld machine tool.

In one specific embodiment of the present invention, the system furthermore includes a handheld machine tool. The handheld machine tool and the battery-powered handheld vacuum device are designed to be carried together in the receiving space of the tool carrying case.

In another development of the present invention, the system encompasses at least one battery pack. The battery pack and the battery-powered handheld vacuum device are designed to be carried together in the receiving space of the tool carrying case. The battery pack is developed to be attached in reversible manner as exchangeable battery pack either to the handheld vacuum device or the handheld machine tool.

DETAILED DESCRIPTION OF THE INVENTION

Figure 1:
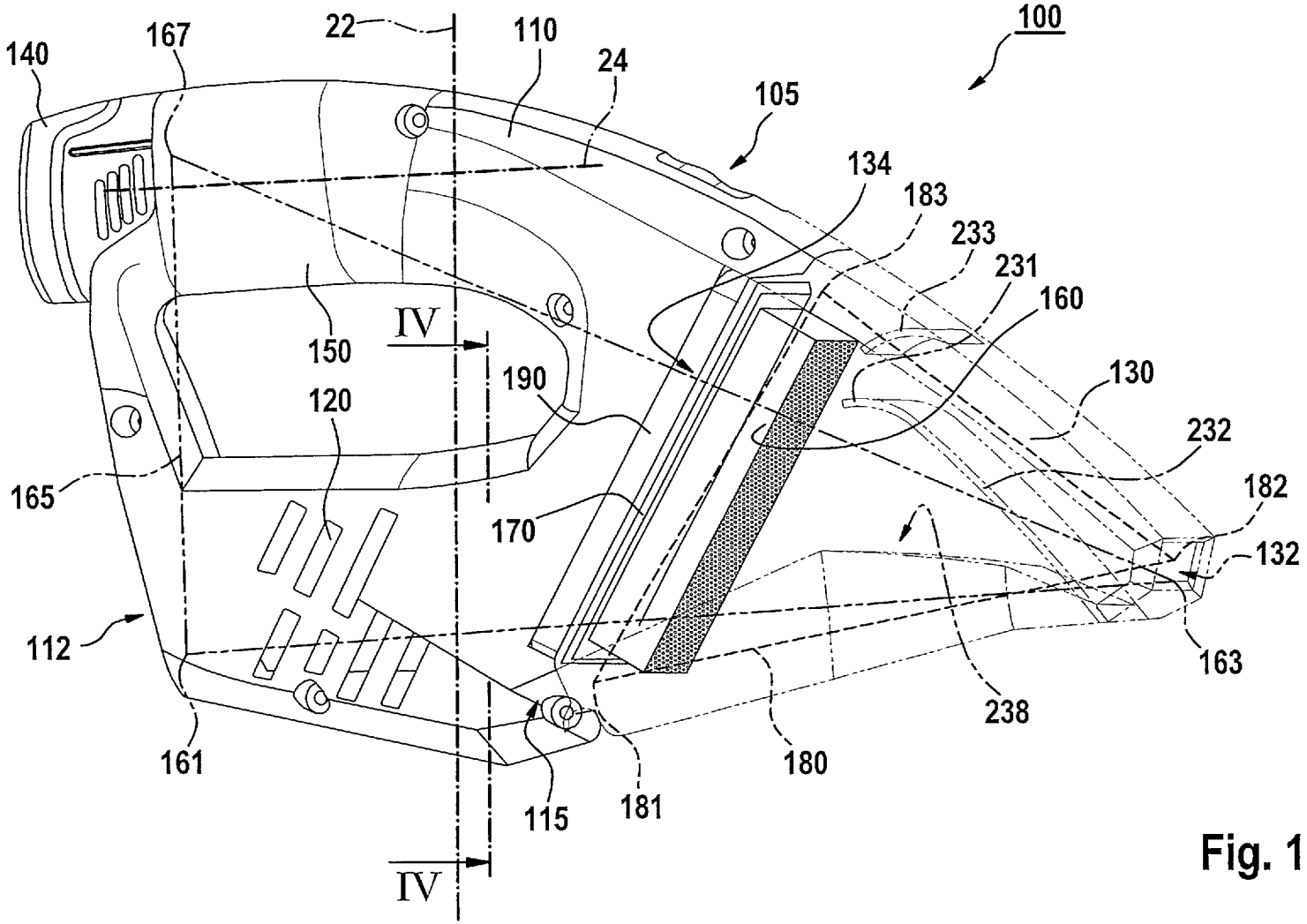
FIG. 1 shows a perspective side view of a battery-powered handheld vacuum device according to one specific embodiment.

FIG. 1 shows a battery-powered handheld vacuum device 100 according to one specific embodiment, which is developed for use on building sites, in particular. It has a motor housing 110, on which a dust collection box 130 is fixed in place in a releasable manner. Disposed inside motor housing 110 are at least one drive motor 120 provided with a fan impeller (220 in FIG. 2), and a battery pack 140 for the current supply of drive motor 120 independently of an electrical network. Handheld vacuum device 100 may optionally include a charge state display for monitoring a corresponding charge state of battery pack 140.

Battery pack 140, for example, engages with motor housing 110 only regionally, as will be described below. Preferably, battery pack 140 has at least three battery cells (not shown further) and supplies a nominal voltage of 10.8V at an available capacity of 1.3 Ah, 1.5 Ah, 2.0 Ah or 4 Ah. Battery pack 140 has a battery pack housing, which is not further denoted here and which accommodates the battery cells in their entirety. Battery pack 140 is preferably designed in the way of an exchangeable battery pack and attached to motor housing 110 in reversible manner, such as snapped on. The battery pack housing has at least one locking element 142 for the releasable affixation of battery pack 140 inside handle 150. In the embodiment shown, locking element 142 is embodied as elastic detent. Battery pack 140 also has at least one release element 144. In the embodiment shown, release element 144 is developed as a release tab that is able to be operated manually. Battery pack 140 is plugged into handle 150 along insertion direction 26. Insertion direction 26 essentially runs parallel to a main extension axis 24 of handle 150. In the inserted state, battery pack 140 is at least partially accommodated in handle 150. In an inserted state, the area of battery pack 140 accommodated in handle 150 is disposed in the interior of a gripping region of handle 150. The gripping region of handle 150 is formed by the contact surface of handle 150 that is gripped by an operator of handheld vacuum device 100.

For the purposes of illustration, motor housing 110 forms a vacuum device housing 105 together with dust collection box 130, which is provided with an air opening 115, formed on motor housing 110, on which dust collection box 130 is mounted in detachable manner. A visco-elastic seal 190, especially an annular rubber sleeve, is disposed in the region of this air opening 115, preferably between dust collection box 130 and motor housing 110, in order to seal at least motor housing 110 and dust collection box 130. It is preferably designed to mount a filter medium 160 and/or a filter holder 170 supporting filter medium 160 on motor housing 110 in airtight manner, especially to snap it in place.

In the transverse direction of handheld vacuum device 100, which is aligned in approximately perpendicular manner to the paper plane in FIG. 1, vacuum device housing 105 has an at least roughly triangular cross-section 165 which has three corners 161, 163, 167. Preferably, at least one air discharge opening 112 is formed in the region of a first corner 161. Drive motor 120 is disposed in the region between first corner 161 and second corner 163. Dust collection box 130 is situated in the region of second corner 163, in such a way that an air intake opening 132 of dust collection box 130 is situated in second corner 163. A handle 150 is formed in the region between second corner 163 and a third corner 167, and battery pack 140 is situated in third corner 167 such that it engages with handle 150 at least regionally.

Preferably, an operating element (330 in FIG. 2) for switching drive motor 120 on and off is situated on a side of handle 150 facing away from drive motor 120. Furthermore, an actuating element (296 in FIG. 2), which preferably is acted upon by a spring, is situated in the region between this operating element (330 in FIG. 2) and dust collection box 130, preferably likewise on the side of handle 150 facing away from drive motor 120; this actuating element is able to be operated to release dust collection box 130 mounted on motor housing 110, as described below in connection with FIG. 2.

In the transverse direction of handheld vacuum device 100, which, as described above, is aligned approximately perpendicular to the paper plane in FIG. 1, dust collection box 130 has an at least roughly triangular cross-section 180 including three box corners 181, 182, 183. A first box corner 181 is facing drive motor 120; air intake opening 132 is developed at a second box corner 182; and a third box corner 183 is facing handle 150.

A dust collection space 238, delimited by an air guidance element 232, is preferably developed in the region between first and second box corner 181 and 182. Preferably, air guidance element 232 is provided in the region between second and third box corner 182 and 183 and is designed to route an air flow (236 in FIG. 2) aspirated into dust collection box 130 through air intake opening 132, in the direction of third box corner 183.

Dust collection box 130 has an opening 134 in the region between first and third box corner 181 and 183. This opening 134 is preferably developed to accommodate at least filter medium 160. Opening 134 is preferably developed in such a way that filter medium 160 accommodated or situated therein extends at least in approximately perpendicular manner with respect to air guidance element 232.

At least one air redirection element 231, 233, (for illustrative purposes, two air redirection elements 231, 233), is/are preferably provided in the region of third box corner 183. They are designed to redirect the aspirated air flow (236 in FIG. 2), routed along air guidance element 232, in the direction of first box corner 181.

Figure 2:
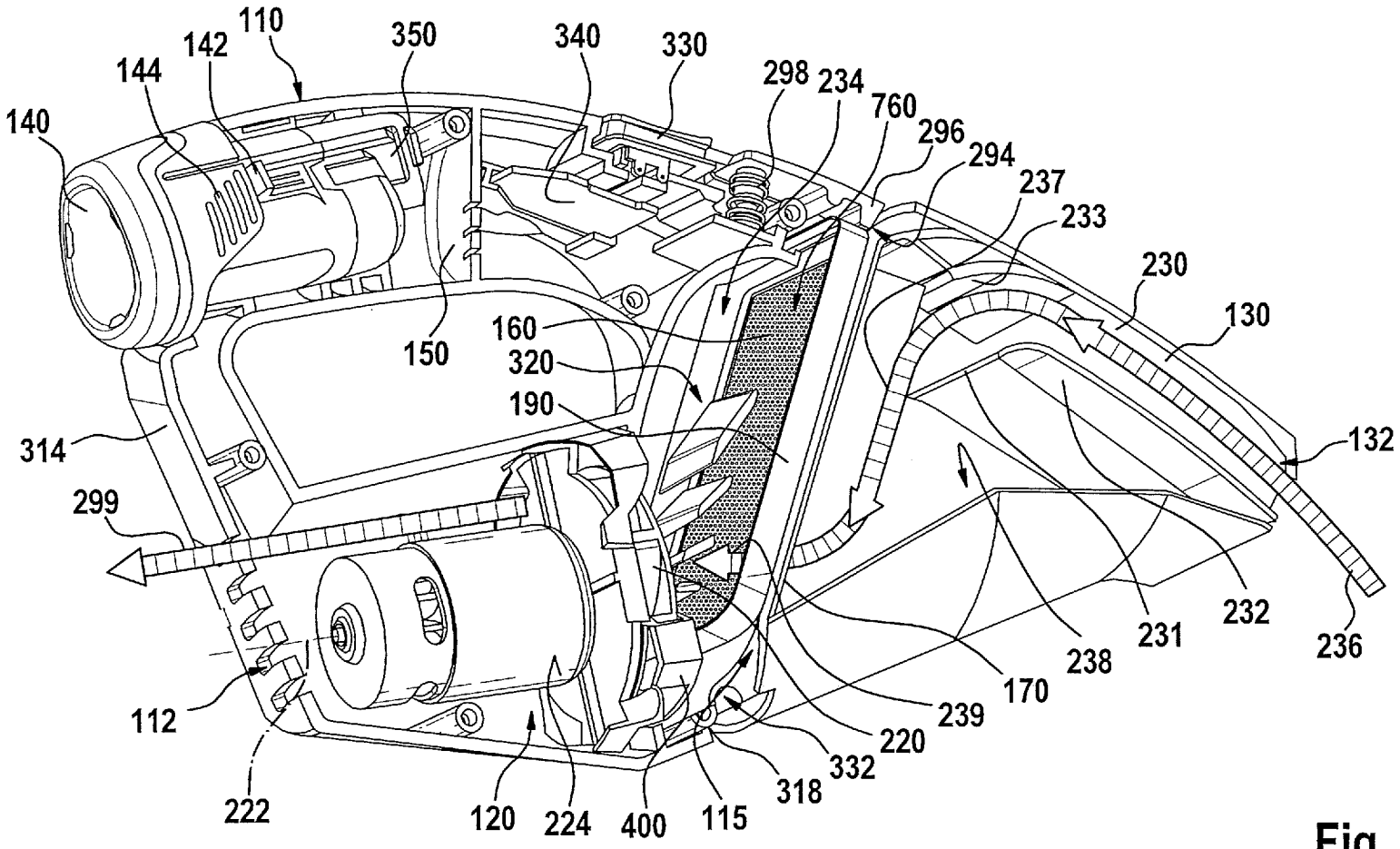
FIG. 2 shows an at least regionally longitudinal section of the battery-powered vacuum device from FIG. 1.

FIG. 2 shows battery-powered handheld vacuum device 100 of FIG. 1 provided with drive motor 120, whose motor housing 110 preferably is embodied by two housing shells 314 (and 312 in FIG. 3) which are joined to each other, e.g., snapped in, screw-fit, riveted, bonded and/or welded. However, it is pointed out that only housing shell 314 of motor housing 110 forming handle 150 is shown here in order to illustrate a preferred inner design structure of handheld vacuum device 100.

According to one specific embodiment, battery pack 140 disposed in handle 150 is connected to an electronics unit 340 in an electrically conductive manner via contact elements 350. Preferably, these are disposed within motor housing 110, preferably likewise in the region of handle 150, and connected to an operating element 330 for turning drive motor 120 off and on. Electronics unit 340 is designed to at least switch drive motor 120 on and off upon actuation of a corresponding operating element 330, and to control drive motor 120 when handheld vacuum device 100 is in operation.

Preferably, an actuating element 296, which is acted on by a spring element 298, e.g., a pressure spring, to assume a locking position, is situated in the region between operating element 330 and dust collection box 130. By way of example, it has a detent hook 294, which is used to lock dust collection box 130 on motor housing 110 in the region of a first axial end of air opening 115. In the region of the opposite lying, second axial end of air opening 115, dust collection box 130 is preferably pivotably supported at a pivot element 318 embodied on motor housing 110, preferably via a hinged bearing 332 formed on dust collection box 130. Hinged bearing 332, for instance, is formed in the manner of an arched receptacle, and pivot element 318 is embodied in the manner of a pin- or bolt-shaped support.

Figure 4:
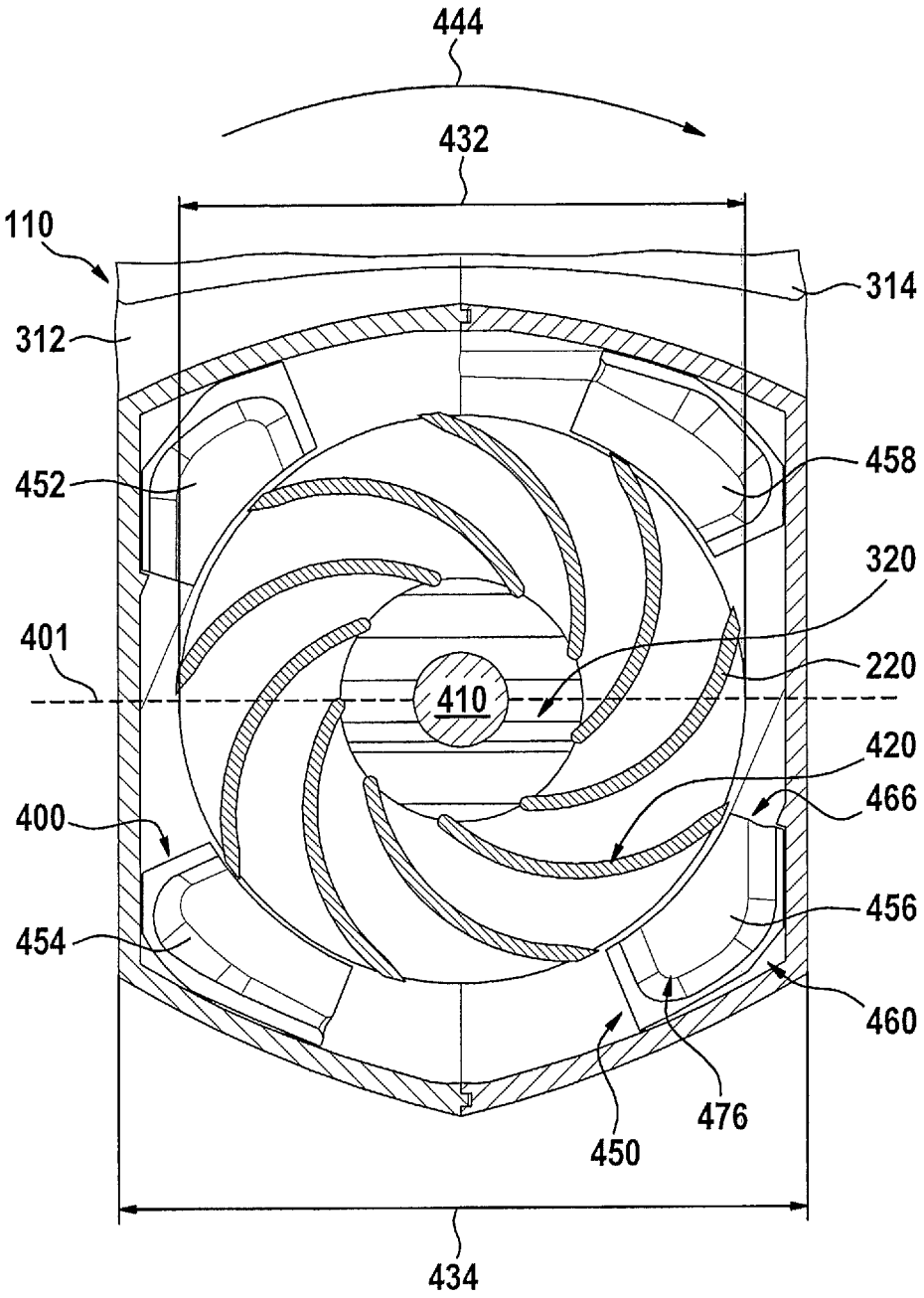
FIG. 4 shows a sectional view of a section of the battery-powered handheld vacuum device of FIG. 1, viewed in the direction of arrows IV-IV of FIG. 1.
Figure 5:
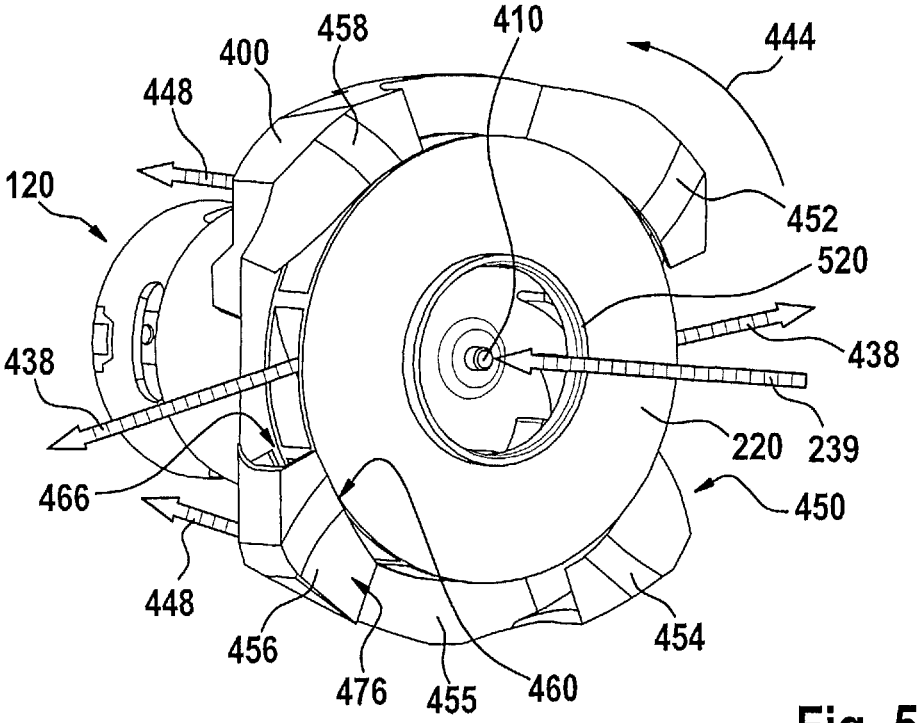
FIG. 5 shows a perspective view of a drive motor, provided with a redirection device, of the battery-powered handheld vacuum device of FIG. 1.
Figure 6:
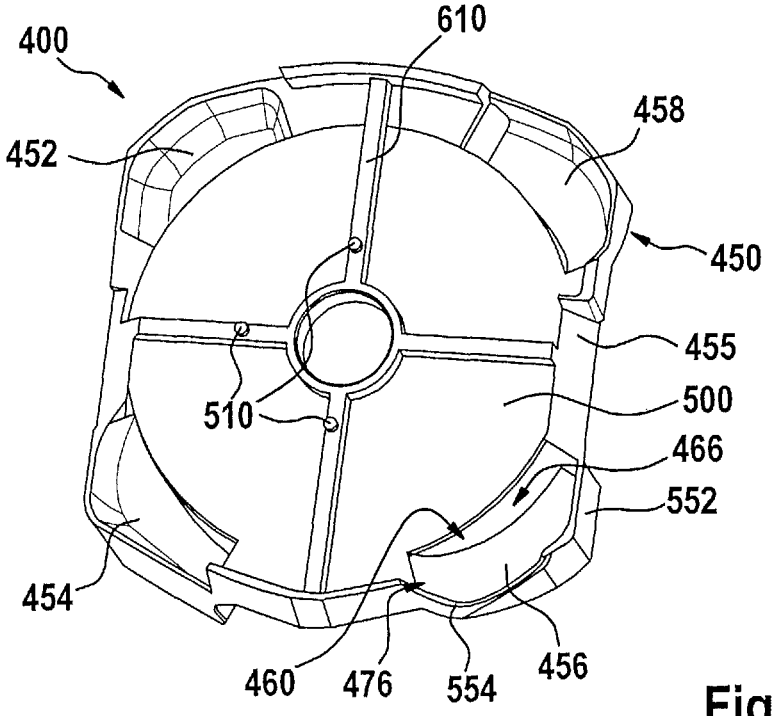
FIG. 6 shows a perspective rear view of the redirection device of FIG. 5.

Drive motor 120 provided with housing 224 is situated in the region between pivot element 318 and the at least one air discharge opening 112 of motor housing 110. Preferably, a fan impeller 220 rotatable about an axis of rotation 222, and a redirection device 400 which will be described below in connection with FIG. 4 through 6, are disposed on drive motor 120.

Redirection device 400 is facing air opening 115, which preferably is aligned at an angle with respect to axis of rotation 222 of fan impeller 220. An air guidance duct 234 is developed on motor housing 110 in the region of air opening 115, which duct is provided to route an air flow from air opening 115 in the direction of impeller fan 220. A finger protection 320 having a multiplicity of ribs that are inclined in the direction of axis of rotation 222, is developed in this air guidance duct 234. Furthermore, filter holder 170 is disposed in air opening 115, which preferably has an at least virtually planar design.

Filter medium 160, or at least a preferably rectangular filter base 760 of filter medium 160, is fixed in place on filter holder 170, preferably in a sealed manner, e.g., bonded. Filter medium 160 is described below in connection with FIGS. 3 and 8. For environmental reasons, filter holder 170 is preferably made of PP, cardboard and/or PE and disposed in air opening 115 at an angle with respect to axis of rotation 222 of fan impeller 220.

Filter medium 160 and/or filter holder 170, as described above, are preferably fixated inside air opening 115 via visco-elastic seal 190, the latter being disposed in a sealing manner between motor housing 110 and dust collection box 130. Dust collection box 130 provided with dust collection space 238, and motor housing 110 are preferably designed to route an air flow 236, aspirated into dust collection box 130 through air intake opening 132 of dust collection box, to air discharge opening 112 of motor housing 110 in a form that at least approximates an S or Z shape in at least some sections, as described in the following text.

Air flow 236 aspirated through air intake opening 132 is guided along an air guidance section 230, formed by air guidance element 232 of dust collection box 130, to the two air redirection elements 231, 233 of dust collection box 130, where it is redirected to form an air flow 239 that is at least partially perpendicular to aspirated air flow 236. This redirected air flow 239 flows to filter medium 160, at least partially approximately parallel to filter base 760, through filter medium 160, in order to then flow as purified air flow 239 via finger protection 320 to fan impeller 220. Then, purified air flow 239 is routed via fan impeller 220 to redirection device 400, which redirects it in the direction of the at least one air discharge opening 112 so that it may exit there from motor housing 110 as discharged air flow 299.

Figure 3:
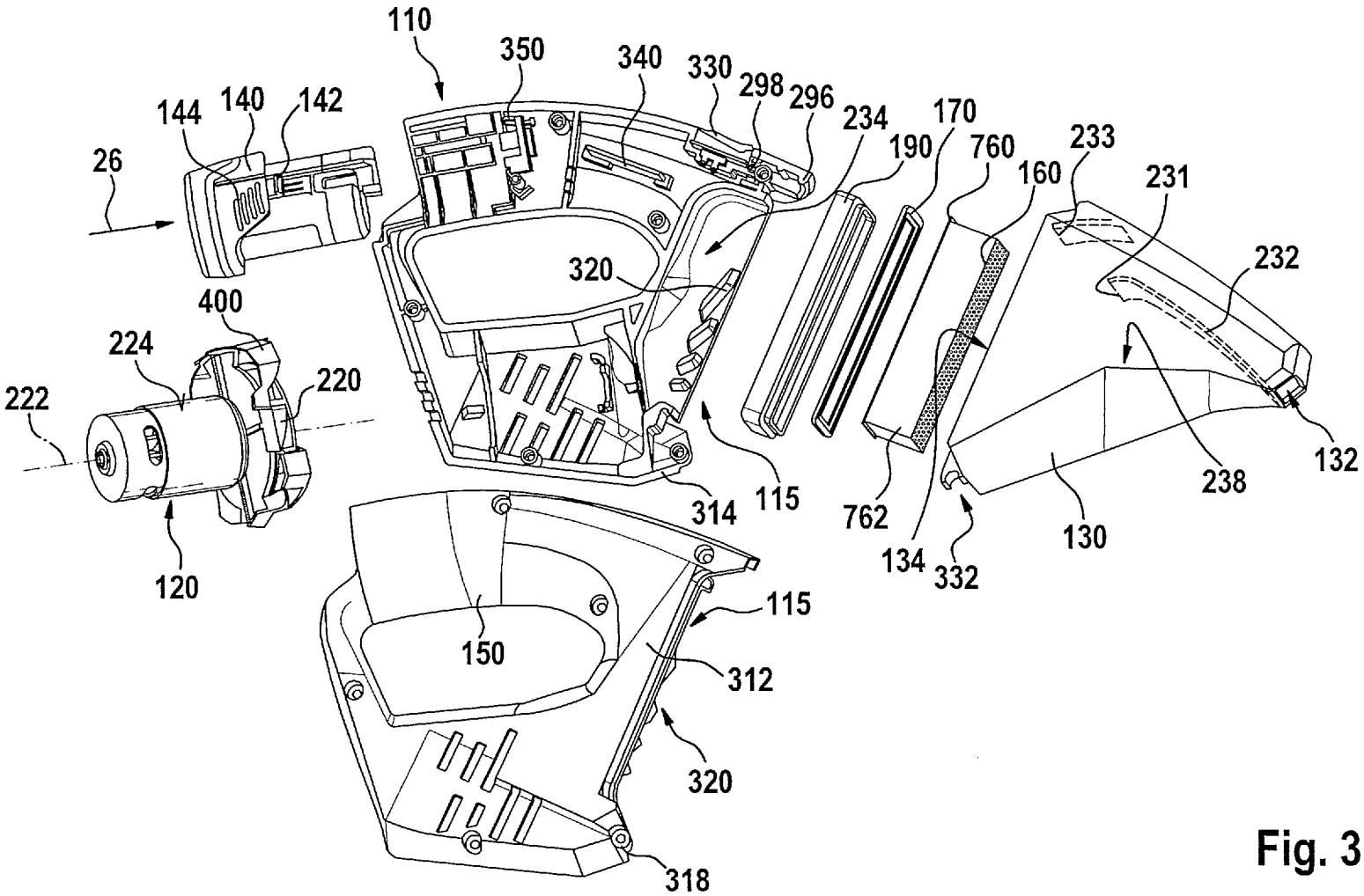
FIG. 3 shows an exploded view of the battery-powered handheld vacuum device from FIG. 1.

FIG. 3 shows battery-powered handheld vacuum cleaner 100 of FIGS. 1 and 2 in order to illustrate filter medium 160, which is preferably designed as a flat pleated filter having a multitude of filter pleats 762 disposed on rectangular filter base 760. In addition, FIG. 3 illustrates an exemplary second housing shell 312 of motor housing 110, as well as hinged bearing 332 formed on dust collection box 130, and pivot element 318 formed on motor housing 110.

However, it is pointed out that the description of filter medium 160, which is developed in the form of a flat pleated filter, is of merely exemplary character and not meant to restrict the present invention. Instead, as an alternative, filter medium 160 may also take the form of a cylindrical cartridge having a cartridge center axis that is at least approximately coaxial with axis of rotation 222 of fan impeller 220 of FIGS. 1 and 2.

FIG. 4 shows a section of motor housing 110 of FIGS. 1 to 3, formed with housing shells 312, 314 of FIG. 3, with fan impeller 220 which is exemplarily embodied in the way of a radial fan impeller having a plurality of fan wings 420, and redirection device 400 of FIGS. 2 and 3. Impeller fan 220, which is able to be driven in a direction of rotation 444 by drive motor 120 of FIGS. 1 to 3 when handheld vacuum device 110 of FIGS. 1 to 3 is in operation, is situated on a rotatable driven shaft 410 of drive motor 120, which forms axis of rotation 222 of FIGS. 2 and 3, and is mounted thereon in a suitable manner. However, it is pointed out that the description of a radial fan impeller is of merely exemplary character and should not be seen as restriction of the present invention. Instead, other types of fan impellers such as an axial fan impeller, may be used as well. In this case, it may perhaps be possible to dispense with redirection device 400.

According to one specific embodiment, radial fan impeller 220 has an outer diameter 432. In addition, in the region of radial fan impeller 220, motor housing 110 has at least one outer width 434 that amounts to maximally 125% of outer diameter 432 of radial fan impeller 220. For example, given an outer diameter 432 of radial fan impeller 220 of approximately 60 mm, outer width 434 amounts to maximally 75 mm.

The "outer width" of motor housing 110 in the context of the present invention describes a dimension from a first to a second outer side of motor housing 110. By way of example, outer width 434 is situated at least approximately in the region of a center axis 401 of redirection device 400.

Redirection device 400 preferably has at least two, and preferably a plurality, of spaced apart redirection regions 450, each being provided with at least one air guidance geometry 460. The latter preferably has at least one air intake opening 466 and a scoop-shaped air redirection section 476.

By way of example, four redirection regions 452, 454, 456, 458 have been provided in FIG. 4. Preferably, each redirection region 452, 454, 456, 458 has an air guidance geometry that corresponds to air guidance geometry 460, so that in the above text, only air guidance geometry 460 of redirection region 456 of redirection device 400 has been described to keep the description concise.

It is pointed out that redirection device 400 is preferably developed as a separate component. However, as an alternative, it is also possible to develop redirection device 400 in one piece with motor housing 110, or to premold it on motor housing 110.

FIG. 5 shows drive motor 120 of FIGS. 1 to 3 together with radial fan impeller 220 mounted on its driven shaft 410, as well as redirection device 400 of FIGS. 2 to 4 in order to illustrate the method of functioning of redirection device 400. It preferably has a plate-shaped base 500, on which the four redirection regions 452, 454, 456, 458 of FIG. 4 are embodied, which have been provided with at least one air guidance geometry 460 in each case, as described in connection with FIG. 4. The four redirection regions 452, 454, 456, 458 are preferably developed in a peripheral region of plate-shaped base 500, which is denoted by reference numeral 455.

According to one specific embodiment, a circumferential rib 520 is formed on radial fan impeller 220, on its end face facing away from drive motor 120. It is preferably used to at least reduce a corresponding gap dimension, i.e., a radial clearance between radial fan impeller 220 and motor housing 110 of FIGS. 1 to 4. Volume flow losses due to leakage flows, which may occur as a result of overpressure in motor housing 110 of FIGS. 1 to 4 and vacuum pressure in dust collection box 130 of FIGS. 1 to 3 when handheld vacuum device 100 of FIGS. 1 to 3 is in operation, are thereby able to be at least reduced.

When drive motor 120 is in operation, radial fan impeller 220 is rotatably driven in the direction of rotation 444 of FIG. 4, aspirates air flow 239 in so doing as described under FIG. 2, and uses it to generate, or to convert it into, an air flow 438 which is directed radially in the outward direction, the air flow also being referred to as "radial air flow" in the following text. This air flow 438 enters redirection regions 452, 454, 456, 458 through air intake openings 466 thereof, and its scoop-like air redirection sections 476 redirect it into an air flow 448 that is at least approximately coaxial with respect to drive motor 120. In the process, prior to being redirected to form the at least approximately coaxial air flow 448, radial air flow 438 is redirected by scoop-shaped air redirection sections 476 in the direction of rotation 444 of radial fan impeller 220, preferably in the form of a spiral, so as to flow around it.

FIG. 6 shows redirection device 400 of FIG. 5 provided with plate-shaped base 500 and four redirection regions 452, 454, 456, 458, in order to illustrate air intake openings 466 and scoop-shaped air redirection sections 476.

According to one specific embodiment, at least one reinforcement rib, preferably a multiplicity of reinforcement ribs, is/are developed on an end face, facing drive motor 120 in FIG. 5, of plate-shaped base 500, of which only a single reinforcement fin has been denoted by reference numeral 610 in order to simplify the drawing. A fixation pin 510 is provided on at least one, by way of example on three, reinforcement ribs 610, which pins are designed to fixate plate-shaped base 500 on drive motor 120 of FIG. 5. In case of an asymmetrical placement of fixation pins 510 on plate-shaped base 500, they may also be used to align and position redirection device 400 on drive motor 120 of FIG. 5.

Figure 7:
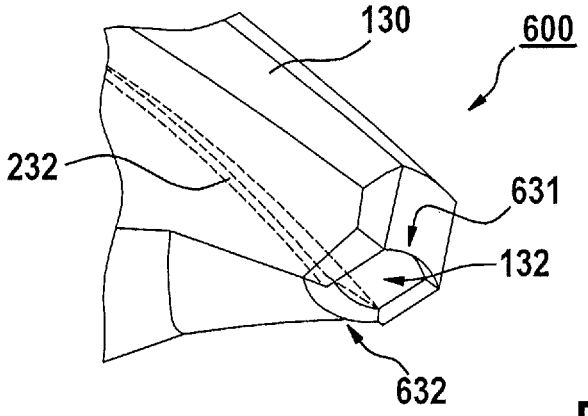
FIG. 7 shows a perspective view of an air intake opening of a dust collection box of the battery-powered handheld vacuum device of FIG. 1.

FIG. 7 shows a section 600 of dust collection box 130 of FIGS. 1 to 3, which is provided with air guidance element 232, to illustrate its air intake opening 132. According to one specific embodiment, section 600 may also be developed as a separate component that is plugged into dust collection box 130, so that it can be exchanged if no longer operable.

Preferably, air entry opening 132 is made of a visco-elastic material. On a lower side (in FIG. 7) of air intake opening 132, it preferably has an edge 632 that is rounded at a predefined radius, and on an upper side (in FIG. 7) of air intake opening 132, it preferably has an edge 631 that tapers to a point.

Edge 631 tapering to a point is used to detach dust particles when pulling handheld vacuum device 100 of FIGS. 1 to 3 across an object to be cleaned, such as a carpet. Such pulling corresponds to a motion of handheld vacuum device 100 of FIGS. 1 to 3, toward the left in FIG. 1.

Rounded edge 632 makes it easier to push handheld vacuum device 100 of FIGS. 1 to 3 across an object to be cleaned, such as a carpet. Such pushing corresponds to a motion of handheld vacuum device 100 of FIGS. 1 to 3, toward the right in FIG. 1. Moreover, using rounded edge 632, a corresponding distance to the object surface is able to be varied with the aid of a pivoting motion.

Figure 8:
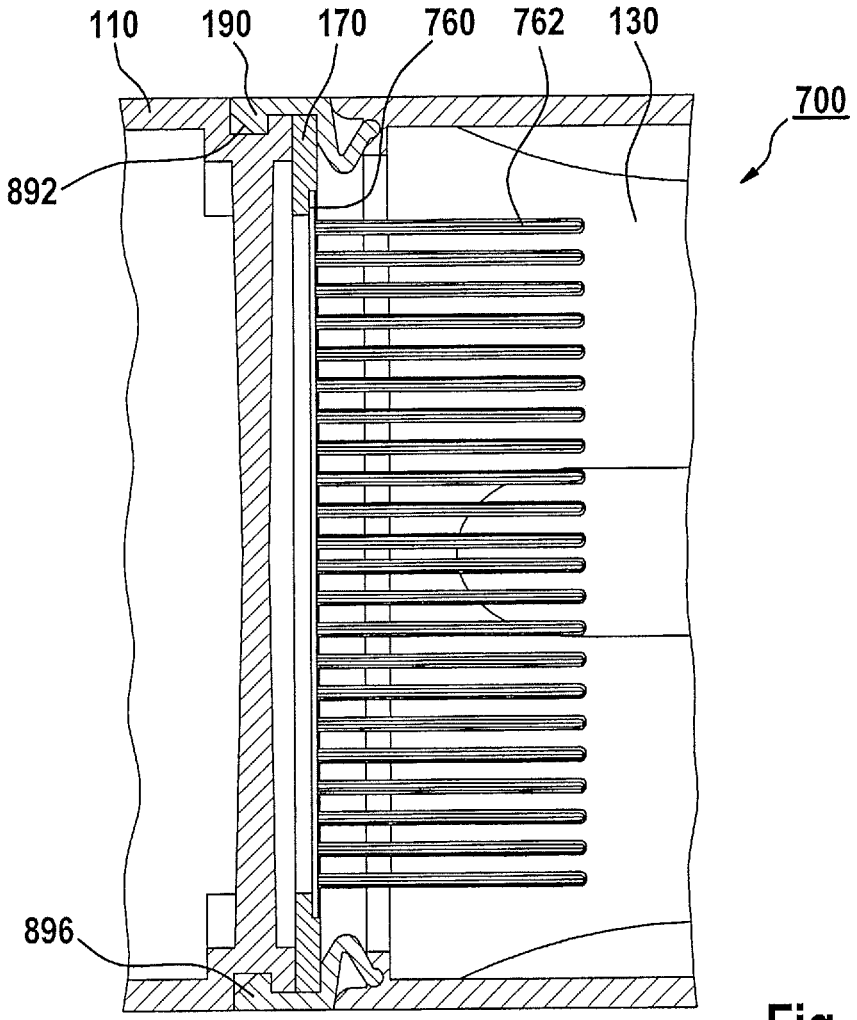
FIG. 8 shows a side view of a filter medium situated inside the battery-powered handheld vacuum device of FIG. 1.

FIG. 8 shows a section 700 of handheld vacuum device 100 of FIGS. 1 to 3, to illustrate filter medium 160, which is fixed in place on motor housing 110 by visco-elastic seal 190. Preferably, as described above, the filter medium is developed in the form of a flat pleated filter, which has a rectangular filter base 760 and a multitude of filter pleats 762, rectangular filter base 760 being attached to filter holder 170. By way of example, filter holder 170 is snapped in place on motor housing 110 via visco-elastic seal 190 provided in exemplary manner with detent members 892, 896.

Figure 9:
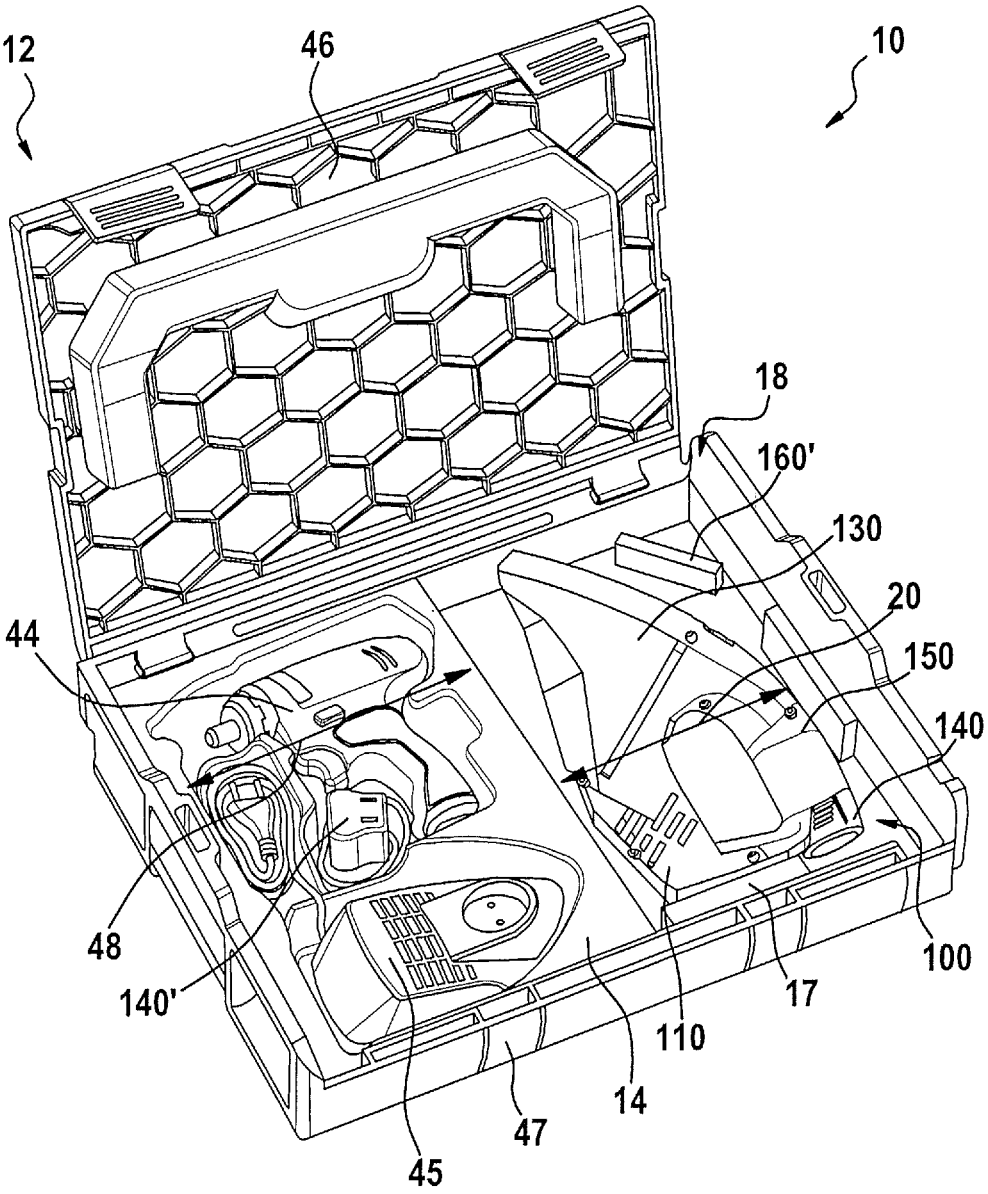
FIG. 9 shows a system according to the present invention, having a tool carrying case and a battery-powered handheld vacuum device, in a perspective view.

FIG. 9 shows a system 10 having a tool carrying case 12, a tool affixation means 14, a battery-powered handheld vacuum device 100 with inserted battery pack 140, a separate battery pack 140', a handheld machine tool 44, and a charger 45 for charging battery packs 140, 140'. Tool carrying case 12 has a case lid 46 and a base element 47. Case lid 46 delimits a receiving space 18 of tool carrying case 12 on one side. Base element 47 delimits receiving space 18 of tool carrying case 12 on five sides. When case lid 46 is closed, case lid 46 and base element 47 delimit receiving space 18 of tool carrying case 12. Tool carrying case 12 is used for jointly transporting handheld vacuum device 100 with inserted battery pack 140, handheld machine tool 44, charger 45, and battery pack 140'. Handheld vacuum device 100, battery pack 140', handheld machine tool 44, and charger 45 are designed to be removable from tool carrying case 12 when case lid 46 is open. Battery packs 140, 140' each have a nominal voltage of 10.8 Volt. Battery packs 140, 140' are provided with battery cells on lithium-ion basis. Battery pack 140' is used as a replacement battery pack. Tool carrying case 12 accommodates additional components of handheld vacuum device 1, as replacement parts and/or accessory parts, such as a crevice nozzle 17 and a filter medium 160', for example.

Battery packs 140, 140' are designed to be optionally usable for the voltage supply of handheld vacuum device 100 or for the voltage supply of handheld machine tool 44, in that one of battery packs 140, 140' is releasably plugged into handle 150 of the handheld vacuum device or is releasably plugged into the handle of handheld machine tool 44.

Tool affixation means 14 and handheld vacuum device 100 are designed to be carried together in receiving space 18 of tool carrying case 12. Tool affixation means 14 and handheld vacuum device 100 essentially take up one half of receiving space 18 in each case. Handheld vacuum device 100 has at least one outer extension 20 parallel to a main extension plane 22 of the handheld vacuum device, of approximately 170 mm. Tool affixation means 14 has an outer extension 48 parallel to a main extension plane of approximately 180 mm. Along its longest edge, receiving space 18 has a length of 378 mm.

A tool affixation means 14 in particular describes a means provided to fixate handheld machine tool 44 and/or battery pack 140', in particular together with case lid 46 of tool carrying case 12, in form-locking and/or force-locking manner. When handheld machine tool 44 and/or battery pack 140' are/is removed, tool affixation means 14 preferably remains in receiving space 18 of tool carrying case 12. Tool affixation means 14 is preferably placed in tool carrying case 12 without being attached, in particular. As an alternative, tool affixation means 14 could be mechanically linked to tool carrying case 12, and/or be at least partially developed in one piece with tool carrying case 12.

What is claimed is:

1. A system, comprising:

a battery-powered handheld vacuum device for use on building sites, the battery-powered handheld vacuum device including: a dust collection box; a motor housing; a drive motor having a fan impeller; and a battery pack for supplying the drive motor with current independently of an electrical network; wherein the drive motor and the battery pack are provided in the motor housing, and wherein the dust collection box is fixed in place on the motor housing in releasable manner, and wherein a handle, with which the battery pack engages at least regionally in reversible manner, is formed on the motor housing, and wherein an air opening is formed on the motor housing, the dust collection box being fixed in place on the air opening in a releasable manner;

a tool carrying case having a receiving space, wherein the battery-powered handheld vacuum device is configured to be transported in the receiving space of the tool carrying case; and a handheld machine tool, wherein the handheld machine tool and the battery-powered handheld vacuum device are configured to be jointly transported in the receiving space of the tool carrying case, wherein the battery-powered handheld vacuum device occupies less than two thirds of the receiving space of the tool carrying case.

2. The system as recited in claim 1, wherein the battery-powered handheld vacuum device has at least one outer extension parallel to a main extension plane of the battery-powered handheld vacuum device, the at least one outer extension being less than 250 mm.

3. The system as recited in claim 1, wherein the battery pack and the battery-powered handheld vacuum device are configured to be jointly transported in the receiving space of the tool carrying case.

4. A battery-powered handheld vacuum device for use on building sites, comprising:

a dust collection box;

a motor housing;

a drive motor having a fan impeller; and a battery pack for supplying the drive motor with current independently of an electrical network;

wherein the drive motor and the battery pack are provided in the motor housing, and wherein the dust collection box is fixed in place on the motor housing in releasable manner, and wherein a handle, with which the battery pack engages at least regionally in reversible manner, is formed on the motor housing, wherein an air opening is formed on the motor housing, and wherein the dust collection box is fixed in place on the air opening in releasable manner, wherein the fan impeller has an outer diameter and the motor housing has at least one outer width in the region of the fan impeller, the at least one width of the motor housing being maximally 125% of the outer diameter of the fan impeller, wherein the fan impeller is a radial fan impeller, and wherein a redirection device is provided, on which at least two redirection regions are provided which each have at least one air guidance geometry configured to redirect a radial air flow generated by the radial fan impeller into an air flow which is at least approximately coaxial with respect to the drive motor.

5. The battery-powered handheld vacuum device as recited in claim 4, wherein an air opening is formed on the motor housing, and wherein the dust collection box is fixed in place on the air opening in releasable manner.

6. The battery-powered handheld vacuum device as recited in claim 5, wherein a visco-elastic seal configured as an annular sleeve is disposed in the region of the air opening, between the dust collection box and the motor housing, in order to seal the motor housing and the dust collection box.

7. The battery-powered handheld vacuum device as recited in claim 6, wherein the visco-elastic seal is configured to attach at least one of a filter medium and a filter holder supporting the filter medium to the motor housing in airtight manner.

8. The battery-powered handheld vacuum device as recited in claim 7, wherein the filter holder is disposed in the region of the air opening, and wherein the filter medium is mounted on the filter holder.

9. The battery-powered handheld vacuum device as recited in claim 8, wherein the filter holder is disposed at an angle with respect to an axis of rotation of the fan impeller.

10. The battery-powered handheld vacuum device as recited in claim 8, wherein the filter medium is configured in the form of a flat pleated filter which has a rectangular filter base and a multitude of filter pleats, the rectangular filter base being mounted on the filter holder.

11. The battery-powered handheld vacuum device as recited in claim 8, wherein the air opening is disposed at an angle with respect to an axis of rotation of the fan impeller.

12. The battery-powered handheld vacuum device as recited in claim 6, wherein the fan impeller has an outer diameter (432) and the motor housing has at least one outer width in the region of the fan impeller, the at least one width of the motor housing being maximally 125% of the outer diameter of the fan impeller.

13. The battery-powered handheld vacuum device as recited in claim 12, wherein the fan impeller is a radial fan impeller, and wherein a redirection device is provided, on which at least two redirection regions are provided which each have at least one air guidance geometry configured to redirect a radial air flow generated by the radial fan impeller into an air flow which is at least approximately coaxial with respect to the drive motor.

14. The battery-powered handheld vacuum device as recited in claim 13, wherein the at least one air guidance geometry is configured to initially redirect the radial air flow generated by the radial fan impeller around the radial fan impeller in the form of a spiral, prior to the redirection to form the air flow which is at least approximately coaxial with respect to the drive motor.

15. The battery-powered handheld vacuum device as recited in claim 13, wherein the redirection device has a plate-shaped base on which the at least two redirection regions are provided.

16. The battery-powered handheld vacuum device as recited in claim 12, wherein a predefined plurality of redirection regions which are set apart from each other are provided, the redirection regions being provided in the peripheral region of the plate-shaped base.

17. The battery-powered handheld vacuum device as recited in claim 6, wherein:

the dust collection box has an air intake opening;

an air discharge opening is provided on the motor housing; and the motor housing and the dust collection box are configured to route an air flow, aspirated into the dust collection box through the air intake opening, to the air discharge opening in at least regionally approximately Z-shaped form.

18. The battery-powered handheld vacuum device as recited in claim 17, wherein the dust collection box has an at least approximately triangular cross-section in the transverse direction with three box corners, a first box corner facing the drive motor, an air intake opening being provided on a second box corner, and an air guidance element being provided in the region between the second box corner and a third box corner, the air guidance element being configured to route the air flow, aspirated into the dust collection box through the air intake opening, in the direction of the third box corner.

19. The battery-powered handheld vacuum device as recited in claim 18, wherein a dust collection space, which is delimited by the air guidance element, is formed in the region between the first box corner and second box corner.

20. The battery-powered handheld vacuum device as recited in claim 18, wherein at least one air redirection element is provided in the region of the third box corner, the at least one air redirection element being configured to redirect the aspirated air flow, routed along the air guidance element, in the direction of the first box corner.

21. The battery-powered handheld vacuum device as recited in claim 18, wherein the dust collection box has an opening for the filter medium in the region between the first box corner and third box corner, the filter medium being situated in the opening.

22. The battery-powered handheld vacuum device as recited in claim 21, wherein the filter medium extends at least approximately perpendicularly to the air guidance element.

23. The battery-powered handheld vacuum device as recited in claim 2, wherein:

the dust collection box and the motor housing together form a vacuum device housing which has an at least approximately triangular cross-section in the transverse direction;

the drive motor is situated in the region between the dust collection box and a first corner of the triangular cross-section of the vacuum device housing;

an air intake opening of the dust collection box is situated in a second corner of the triangular cross-section of the vacuum device housing; and the battery pack is disposed in the region of a third corner of the triangular cross-section of the vacuum device housing.

24. The battery-powered handheld vacuum device as recited in claim 23, wherein the handle is formed between the second corner and the third corner of the triangular cross-section of the vacuum device housing.

25. The battery-powered handheld vacuum device as recited in claim 23, wherein an operating element for selectively turning the drive motor on and off is situated on a side of the handle which faces away from the drive motor.

26. A battery-powered handheld vacuum device for use on building sites, comprising:

a dust collection box;

a motor housing;

a drive motor having a fan impeller; and a battery pack for supplying the drive motor with current independently of an electrical network;

wherein the drive motor and the battery pack are provided in the motor housing, and wherein the dust collection box is fixed in place on the motor housing in releasable manner, and wherein a handle, with which the battery pack engages at least regionally in reversible manner, is formed on the motor housing, wherein an air opening is formed on the motor housing, and wherein the dust collection box is fixed in place on the air opening in releasable manner, wherein:

the dust collection box has an air intake opening;

an air discharge opening is provided on the motor housing; and the motor housing and the dust collection box are configured to route an air flow, aspirated into the dust collection box through the air intake opening, to the air discharge opening in at least regionally approximately Z-shaped form.

27. A battery-powered handheld vacuum device for use on building sites, comprising:

a dust collection box;

a motor housing;

a drive motor having a fan impeller; and a battery pack for supplying the drive motor with current independently of an electrical network;

wherein the drive motor and the battery pack are provided in the motor housing, and wherein the dust collection box is fixed in place on the motor housing in releasable manner, and wherein a handle, with which the battery pack engages at least regionally in reversible manner, is formed on the motor housing, wherein an air opening is formed on the motor housing, and wherein the dust collection box is fixed in place on the air opening in releasable manner, wherein the dust collection box has an at least approximately triangular cross-section in the transverse direction with three box corners, a first box corner facing the drive motor, an air intake opening being provided on a second box corner, and an air guidance element being provided in the region between the second box corner and a third box corner, the air guidance element being configured to route the air flow, aspirated into the dust collection box through the air intake opening, in the direction of the third box corner, wherein at least one air redirection element is provided in the region of the third box corner, the at least one air redirection element being configured to redirect the aspirated air flow, routed along the air guidance element, in the direction of the first box corner.

28. A battery-powered handheld vacuum device for use on building sites, comprising:

a dust collection box;

a motor housing;

a drive motor having a fan impeller; and a battery pack for supplying the drive motor with current independently of an electrical network;

wherein the drive motor and the battery pack are provided in the motor housing, and wherein the dust collection box is fixed in place on the motor housing in releasable manner, and wherein a handle, with which the battery pack engages at least regionally in reversible manner, is formed on the motor housing, wherein an air opening is formed on the motor housing, and wherein the dust collection box is fixed in place on the air opening in releasable manner, wherein:

the dust collection box and the motor housing together form a vacuum device housing which has an at least approximately triangular cross-section in the transverse direction;

the drive motor is situated in the region between the dust collection box and a first corner of the triangular cross-section of the vacuum device housing;

an air intake opening of the dust collection box is situated in a second corner of the triangular cross-section of the vacuum device housing; and the battery pack is disposed in the region of a third corner of the triangular cross-section of the vacuum device housing.

* * * * *